US006932231B2

(12) United States Patent
Haynes et al.

(10) Patent No.: US 6,932,231 B2
(45) Date of Patent: Aug. 23, 2005

(54) BEVERAGE CUP LID WITH A CONDIMENT ADDITION WELL

(76) Inventors: Kevin Haynes, 214 Riverside Dr., New Martinsville, WV (US) 26155; Michael Pallotta, 907 Riverside Dr., Sistersville, WV (US) 26175

( * ) Notice: Subject to any disclaimer, the term of this patent is extended or adjusted under 35 U.S.C. 154(b) by 131 days.

(21) Appl. No.: 10/256,370

(22) Filed: Sep. 27, 2002

(65) Prior Publication Data

US 2004/0060934 A1 Apr. 1, 2004

(51) Int. Cl.[7] ..... B65D 3/24; B65D 85/72

(52) U.S. Cl. ..... 220/212; 220/501; 220/505; 220/521; 206/217

(58) Field of Search ..... 220/212, 501, 220/505, 506, 521, 522, 254.3, 713, 502; 229/404; 206/217

(56) References Cited

U.S. PATENT DOCUMENTS 3,285,462 A * 11/1966 Bulmer et al. ..... 220/502
3,743,520 A * 7/1973 Croner ..... 426/87
3,796,813 A * 3/1974 Kurland ..... 426/86
4,264,007 A * 4/1981 Hunt ..... 206/219
4,785,931 A * 11/1988 Weir et al. ..... 206/222
5,035,320 A * 7/1991 Plone ..... 206/219
5,052,553 A 10/1991 De Sanctis
5,054,642 A * 10/1991 Yoshida ..... 220/276
5,431,276 A 7/1995 Lialin
5,529,179 A 6/1996 Hanson
D372,866 S 8/1996 Ahern, Jr.
5,722,558 A * 3/1998 Thompson ..... 220/521
5,894,952 A 4/1999 Mendenhall et al.
5,979,647 A * 11/1999 Han ..... 206/222
6,209,748 B1 * 4/2001 Dunbar ..... 220/521
6,263,923 B1 * 7/2001 Castillo ..... 141/100
6,296,141 B1 * 10/2001 Lukacevic ..... 220/713
6,314,866 B1 11/2001 Melton
6,488,173 B2 * 12/2002 Milan ..... 220/713

* cited by examiner

*Primary Examiner*—Jes F. Pascua
*Assistant Examiner*—Niki M. Eloshway
(74) *Attorney, Agent, or Firm*—J. L. Simunic

(57) ABSTRACT

A spill-resistant beverage cup lid which includes a well for adding liquid or powder condiments to a hot beverage and which also serves as a drinking portal is described. The well includes a plurality of apertures in a side wall of the well allowing the condiments to mix with the beverage. In an alternative embodiment, the well further includes a removable flap.

5 Claims, 1 Drawing Sheet

BEVERAGE CUP LID WITH A CONDIMENT ADDITION WELL

BACKGROUND

The present development is a spill-resistant beverage cup lid which includes a well for adding liquid or powder condiments to a hot beverage. The well is designed to allow the condiment to diffuse within the beverage thereby eliminating the need for a stirrer.

In the fast-food industry, hot beverages are commonly served in disposable cups having a close-fitted lid. The lid typically includes a flap that can be opened to allow the consumer to drink the beverage, and a vent. Indicia such as corporate logos, warning notices, and recycling information may also be included on the lid. If the customer wishes to add condiments, such as creamer or sugar, for the beverage, the lid must be removed, the condiment added, and the lid replaced on the cup. When the lid is removed, there is a risk that the beverage can splash or spill, burning the customer.

Lids have been developed which allow the consumer to add condiments to hot beverages without the need of removing the lid after it has been positioned on the cup. For example, U.S. Pat. No. 5,529,179, issued to Hanson on Jun. 25, 1996, and U.S. Pat. No. 5,431,276, issued to Lialin on Jul. 11, 1998, teach lids having compartments or vessels filled with condiments. With the lid mounted on the cup, the consumer applies pressure to an exterior face of the lid opposing the compartment containing the condiment the consumer wishes to add to the beverage. The pressure causes the compartment to open or rupture releasing the condiment into the beverage. The lids of the '179 and '276 patents thereby allow the consumer to add condiments without removing the lid. However, the lids are not cost efficient because the condiments must be added to the lid when the lid is produced so each consumer receives all the possible condiments which can be added to the beverage regardless of which condiment(s) the consumer desires. Further, because the compartments are filled with the condiments during production, a predetermined amount of each condiment is available in the lid compartments, thereby limiting the freedom of the consumer to determine the quantity of each condiment to add to the beverage.

U.S. Pat. No. 5,894,952 teaches a lid that allows the consumer to add condiments through a "condiment funnel" positioned at the center of the lid. The '952 patent further teaches a stirring rod which fits into the cup through the base of the condiment funnel. The consumer can add the desired type and quantity of condiment to the beverage through the funnel, and then use the stirring rod to disperse the condiment throughout the beverage. Thus, the lid of the '952 patent allows the consumer to use only the condiments of his choice. However, after adding the condiment(s), the consumer must stir the beverage using a stirrer adapted to the lid.

SUMMARY OF THE PRESENT INVENTION

The present invention is a spill-resistant beverage cup lid which includes a well for adding liquid or powder condiments to a hot beverage also serving as a drinking portal. The well is sized such that the consumer can add the desired quantities of the selected condiments to the well. Further, a plurality of apertures are included in a side wall of the well.

In an alternative embodiment, the well further includes a removable flap. The flap can be opened to allow the condiments to be added to the well, then closed to minimize the risk that the hot beverage would splash or spill on the consumer.

DETAILED DESCRIPTION OF THE PREFERRED EMBODIMENTS

The present development is a beverage cup lid having a combination condiment addition well and drinking portal. The lid may be made of a variety of materials and may be combined with a variety of cups. In the figures presented herein, the lid is shown without ornamentation and is shown being used with a disposable insulated cup, such as is commonly used in fast-food establishments to serve hot beverages. It is to be understood that a lid made in accordance with the present invention may be made of a durable material, allowing the user to wash and reuse the lid, and may be combined with reusable cups. The lid may also include indicia or decoration.

Figure 1:
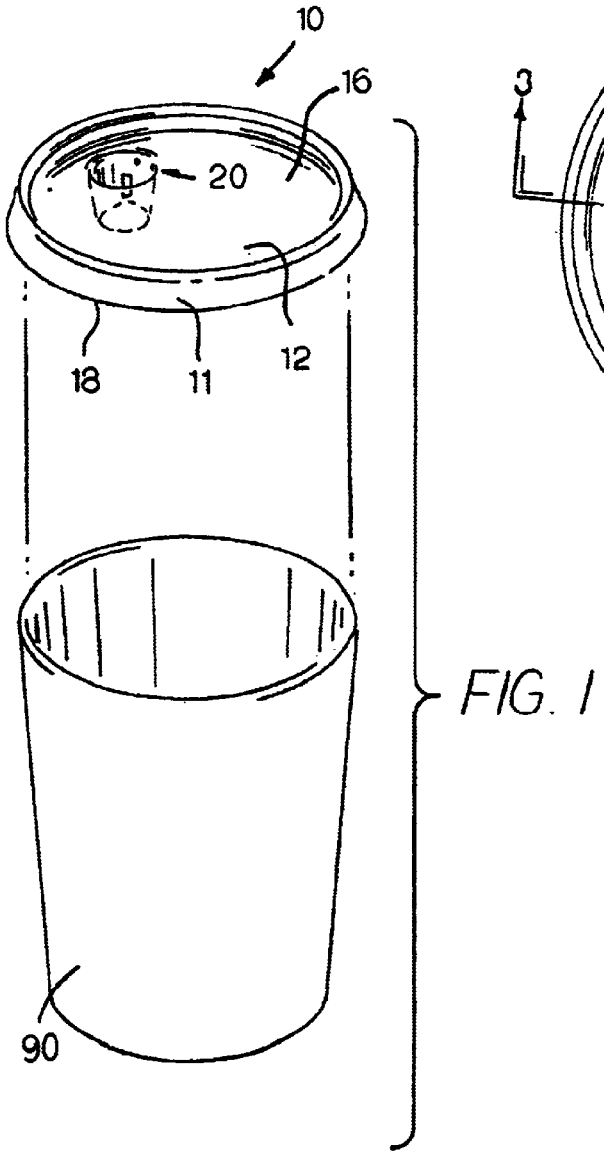
FIG. 1 is a perspective view of a lid made in accordance with the present invention, the lid being shown with a typical disposable cup.
Figure 2:
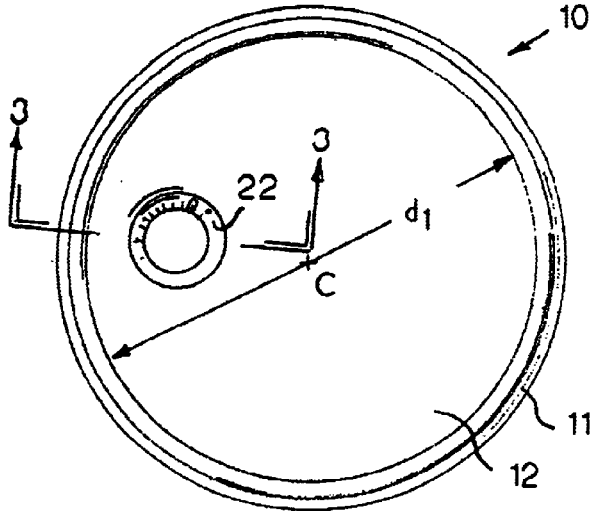
FIG. 2 is a top view of the lid of FIG. 1, with the space between the well and the rim exaggerated.
Figure 3:
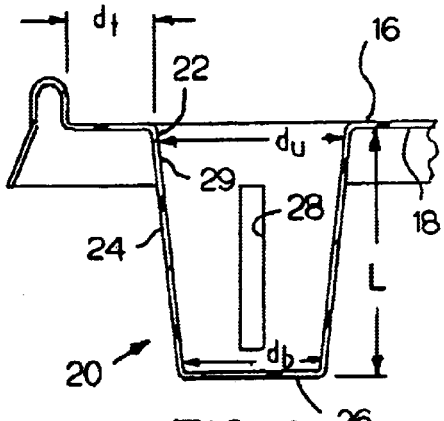
FIG. 3 is a cross-sectional view of the well taken along line 3—3.

FIGS. 1–3 show an embodiment of a beverage cup lid 10 made in accordance with the present invention. Referring to FIG. 1, the lid 10 can be used with a disposable cup 90 for serving a hot beverage. Such lid 10 and cup 90 combinations are commonly used in the fast-food industry. The lid 10 has a major components an essentially flat cover region 12, having a peripheral rim 11, and a condiment addition well 20. Because hot beverages may be served in the cup 90, the lid 10 is proportioned and the rim 11 is preferably adapted to provide a close or tight fit between the cup 90 and lid 10. The tight fit requires that some force be exerted against the rim 11 in order to remove the lid 10 from the cup 90. The cover region 12 has a center, C, and a diameter, $d_l$. The cover region 12 further defines an exterior face 16 and an interior face 18. When the lid 10 is secured to the cup 90, the exterior face 16 is exposed.

The condiment addition well 20 is designed to allow the customer to add condiments, such as creamer or sugar, to the hot beverage without the need for removing the lid 10 from the cup 90. The well 20 is positioned between the center of the cover region, C, and the rim 11. In a preferred embodiment, the addition well 20 is positioned such that it 20 is essentially abutting the rim 11.

The well 20 projects away from the interior face 18 of the cover 12 so that when the lid 10 is secured to the cup 90, the well 20 is positioned within the cup 90. The well 20 has a sidewall 24 and a bottom 26. The well 20 defines an upper edge 22, which is contiguous with the cover 12, and has a length "L" defined as the distance between the upper edge 22 and the bottom 26. The well 20 defines a first diameter, $d_u$, at the upper edge 22, and a second diameter, $d_b$, at the at the bottom 26. In a preferred embodiment, the well 20 is tapered slightly so that the diameter of the upper edge 22, $d_u$, is greater than the diameter of the bottom, $d_b$. This particular well design allows a plurality of lids 10 to be stacked such that the exterior face 16 of each lid 10 abuts the interior face 18 of the neighboring lid 10. The well 20 may be essentially cylindrical or even tapered such that the diameter of the upper edge 22, $d_u$, is smaller than the diameter of the bottom, $d_b$, and the well 20 would function as intended, although the lid 10 would not be stackable. Optionally, the well 20 may have a non-traditional, non-circular periphery, such as an oval or triangular or square shape.

The sidewall 24 includes a slit 28 and an aperture 29. The slit 28 runs lengthwise along the sidewall 24 and allows the condiments in the well 20 to mix with the beverage in the cup 90. The aperture 29 is positioned near the upper edge 22 and on the sidewall 24 in closest proximity to the rim 11. The aperture 29 provides a means to allow the cup 90 to drain essentially completely.

The well 20 is proportioned to allow the customer to add the desired quantities of the selected condiments to the well 20. In an example embodiment, the lid 10 has a diameter of about 3.5", the condiment addition well 20 is positioned such that it 20 is abutting the rim 11, and the well 20 has an upper edge diameter ($d_u$) of about 1.125", a bottom diameter ($d_b$) of about 0.75", a length "L" of 1.25", the slit 28 has a width of about 0.125" and a length of about 0.75" and runs longitudinally along the sidewall 24 of the well 20 leaving about 0.25" sidewall 24 near the upper edge 22 and an additional 0.25" sidewall 24 near the bottom 26, the aperture has a diameter of about 0.125" and is offset from the slit 28 by about 90°.

Although the lid 10 will vent adequately through the aperture 29 and slit 28 of the condiment addition well 20, other venting means may be optionally be included on the lid 10. As is known in the art, a variety of venting designs and styles may be used. Further, optional indicia such as corporate logos, warning notices, and recycling information may be included on the lid 10.

Figure 4:
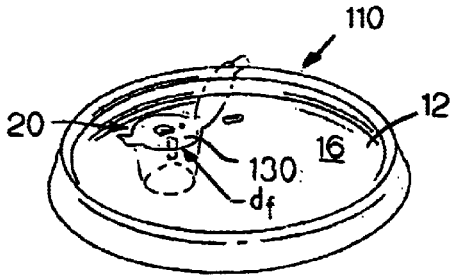
FIG. 4 is a top perspective view of a lid made in accordance with the present invention and further including a flap.

FIG. 4 shows an alternative embodiment 110 of the lid 10 of FIGS. 1–3. The lid 110 is essentially identical to the lid 10 except a flap 130, having a diameter, $d_f$, greater than the upper edge diameter, $d_u$, is affixed to the exterior face 16 of the cover 12 thereby closing or prevent access to the condiment addition well 20. The flap 130 can easily be opened, providing the customer with access to the well 20. In a variation, the flap 130 can be closed after the cup 90 is filled and as it is being transported by the consumer, thereby minimizing the risk that the hot beverage would splash or spill on the consumer.

While particular examples of the present invention have been shown and described, it is understood that variations and modifications may be made without departing from the scope of the development.

What is claimed is:

1. A beverage cup lid comprising:

a. an essentially flat cover region, defining an exterior face and an interior face, and having a peripheral rim and a center; and b. an addition well, having an upper edge contiguous with said cover region and positioned in its entirety between said center and said rim so as to project away from said interior face, said well further having a bottom and a sidewall, said sidewall extending between said upper edge and said bottom, and said sidewall having a lengthwise slit between said upper edge and said bottom and having an aperture near the upper edge and on a portion of the sidewall in closest proximity to the rim.

2. The beverage cup lid of claim 1 wherein said well defines a first diameter at said upper edge and a second diameter at said bottom, and said well is tapered so that said first diameter is greater than said second diameter.

3. The beverage cup lid of claim 1 further including indicia.

4. The beverage cup lid of claim 1 further including a vent.

5. The beverage cup lid of claim 1 further including a flap affixed to said cover region, said flap defining a flap diameter greater than the first diameter at said upper edge.

* * * * *